United States Patent [19]

Schneller

[11] Patent Number: 4,566,241

[45] Date of Patent: Jan. 28, 1986

[54] PROGRESSIVE DEMOUNTABLE PARTITION

[75] Inventor: Joseph W. Schneller, Williamsville, N.Y.

[73] Assignee: National Gypsum Company, Dallas, Tex.

[21] Appl. No.: 596,635

[22] Filed: Apr. 4, 1984

[51] Int. Cl.[4] ..... E04H 1/00

[52] U.S. Cl. ..... 52/481; 52/DIG. 6; 52/363

[58] Field of Search ..... 52/361, 363, 481, 483, 52/242, 779, 489, DIG. 6; 411/467

[56] References Cited

U.S. PATENT DOCUMENTS 2,010,412 8/1935 Parsons ..... 52/242
2,139,641 12/1938 Neumeister ..... 52/779
2,282,631 5/1942 Winship ..... 52/361
2,345,419 3/1944 Olson ..... 52/483
3,948,011 4/1976 Price et al. ..... 52/481

FOREIGN PATENT DOCUMENTS 2046860 11/1980 United Kingdom ..... 411/467

*Primary Examiner*—James L. Ridgill, Jr.
*Attorney, Agent, or Firm*—Robert F. Hause

[57] ABSTRACT

A progressive demountable partition in which gypsum wallboard is affixed against I-shaped vertical studs by a plurality of small sheet metal clips having short tangs projecting into the wallboard back face and having a flange-engaging forwardly extending portion engaged behind the vertical stud flanges.

10 Claims, 3 Drawing Figures

PROGRESSIVE DEMOUNTABLE PARTITION

This invention relates to the attachment of gypsum wallboard to I-shaped metal studs, and particularly to the concealed attachment by fasteners, mechanically affixed to the back face of the gypsum wallboard, which engage the flanges of spaced, parallel, vertical I studs.

BACKGROUND OF THE INVENTION

There are many systems for affixing wallboard to studs in the construction of partitions. Some systems are designed to permit the disassembly of the wall in a way which permits the reuse of the components in a new wall, and such systems are commonly referred to as demountable partitions. If the demountable partition is assembled by starting at one end and working toward the second end and subsequently disassembled by starting at the second end and working back to the first end, with individual panels intermediate of the partition ends being incapable of separate removal and replacement without damage, then the partition is commonly referred to as a progressive demountable partition.

An example of a prior progressive demountable partition is disclosed in U.S. Pat. No. 3,027,605, wherein panels with grooved edges are mounted on the flanges of spaced, parallel, vertical I studs. The grooved edges are provided by laminating two wallboard members with rounded edges or by milling a recess in the edge central portion of a single thick wallboard.

Another progressive demountable partition is disclosed in Canadian Pat. No. 1,034,733, wherein metal clips are affixed to the edges of wallboard by a clip central portion which extends into the joint between the panels and pointed wedges which penetrate into the wallboard edge central portion. The clips include a flat plate portion from which a spring finger extends, for receiving the flanges of spaced, parallel, vertical I studs.

U.S. Pat. No. 2,282,631 discloses a fastener for wallboard wherein a metal plate is folded upon itself to provide a front portion and a rear portion capable of being forced over the edge of a support, with a plurality of pointed, slightly curved ears extending from the front portion to impale and bend over within a wallboard and thus attach the wallboard to the support.

U.S. Pat. No. 4,128,979 discloses a two clip combination for mounting wallboard, wherein one clip has a plurality of straight pointed tangs punched out of a flat plate, directed substantially perpendicularly to the plane of the plate, to be driven into the back of a wallboard. A second clip fits into a slot in the first clip and is then hung over a flange on an upwardly opening, horizontally disposed channel, which extends through openings in parallel vertical studs.

SUMMARY OF THE INVENTION

The present invention consists of a single strip of metal, which,at one end, has a plurality of straight pointed tangs punched out of a flat end portion and at the opposite end has a raised forwardly extending lip for extending behind a stud flange when the clip is affixed to the edge of the back face of a gypsum board by the tangs penetration into the gypsum board.

With an I-shaped stud, four flanges are provided, permitting the edges of two coplanar wallboards to be affixed to the flanges on each of the two sides of the stud, forming a highly simplified and economical progressive demountable partition.

It is an object of the present invention to provide a novel progressive demountable partition and metal clip for use therein.

It is a further object to provide a progressive demountable partition having simplified and highly economical means for attaching gypsum board to the vertical studs of the partition.

It is a further object to provide an improved method of constructing a progressive demountable partition.

BRIEF DESCRIPTION OF THE DRAWINGS

Referring to FIG. 1, there is shown a partition 10 including a floor track 12, a ceiling track 14, and a plurality of parallel vertical studs 16 disposed therebetween. The studs 16 are all formed with an I-shaped cross section including a central web 18 and four flanges 20*a*, 20*b*, 20*c*, and 20*d*, each extending perpendicular to the web 18 at one or the other of the edges 22 of the web 18.

Figure 1:
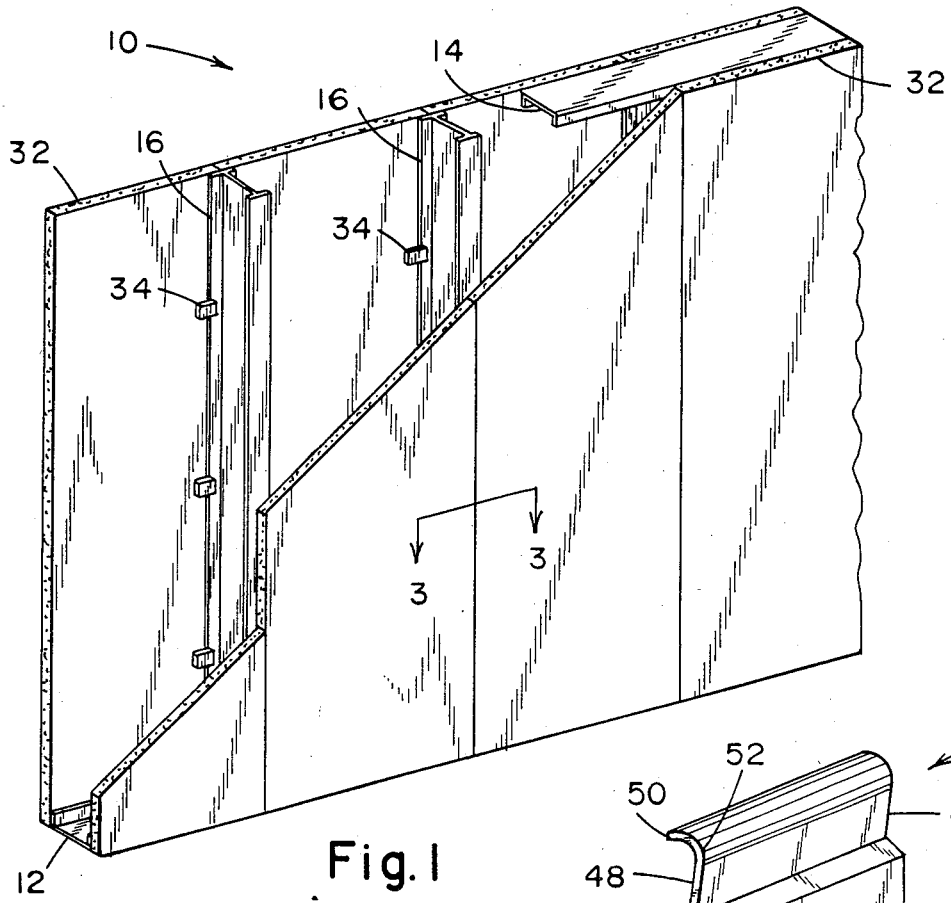
FIG. 1 is an isometric view of a portion of a progressive demountable partition constructed in accordance with the invention.
Figure 2:
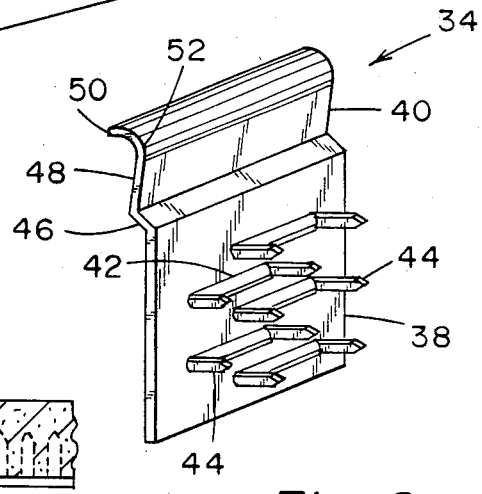
FIG. 2 is an isometric view of the sheet metal wallboard clip used in the partition of FIG. 1.
Figure 3:
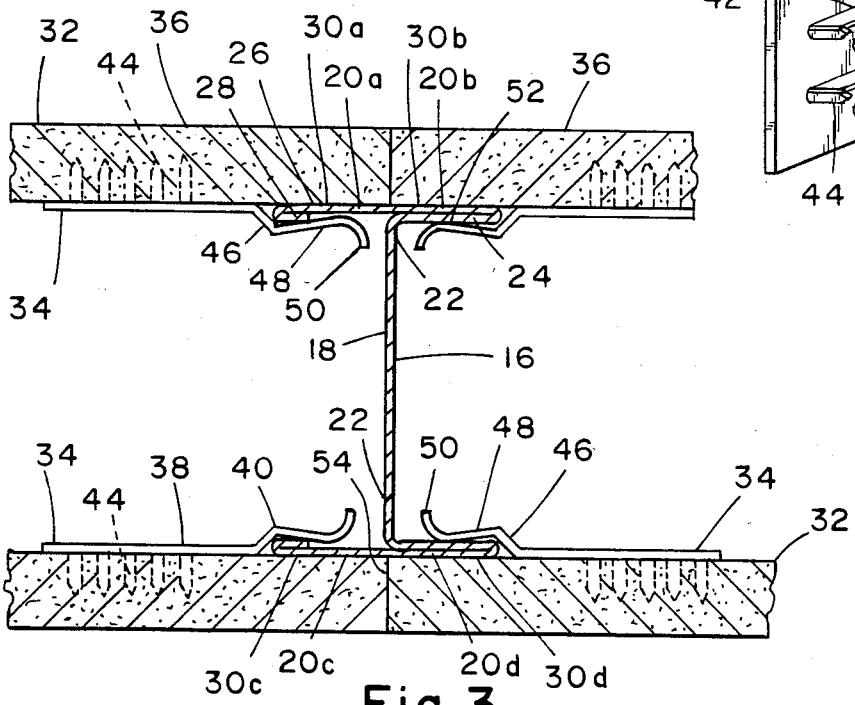
FIG. 3 is a plan view of a cross section of the partition of FIG. 1 taken on line 3—3.

In the preferred embodiment the studs 16 are formed from a single strip of sheet metal folded to provide the above-described structure, including a 90° fold at each edge 22 of web 18, a 180° fold at the outer extremity 24 of each of flanges 20*b* and 20*d* whereby the sheet metal is folded back on itself to extend completely across from the outer extremity 24 of flanges 20*b* and 20*d* to the outer extremity 26 of flanges 20*a* and 20*c*, whereat the sheet metal is again folded 180° to provide a very short double thick flange edge portion 28.

Affixed to the outer surfaces 30*a*, 30*b*, 30*c* and 30*d* of flanges 20*a*, 20*b*, 20*c* and 20*d* are eight foot tall gypsum wallboards 32. Each wallboard 32 has six metal clips 34 affixed to the two vertical edge portions 36, three on each edge portion 36. Tthe clips are placed respectively, on each vertical edge portion 36, two feet, four feet and six feet from the bottom of the wallboard 32.

Clips 34 are approximately two inches long and one and a half inches wide and include a relatively long end, wallboard-engaging rearward flat portion 38 and a relatively short end, flange-engaging forwardly extending bent portion 40. The wallboard-engaging flat portion has five crosswise extending slots 42 which are the result of two straight pointed tangs 44 having been punched from each slot 42 and bent perpendicularly out of the plane of the flat portion 38, forming ten tangs 44 which penetrate and extend into the back of the wallboards 32. The slots 42 and thus the tangs 44 are all about 3/32" wide. The slots 42 are about 5/8 inch long and each tang 44 is about 5/16 inch long. The slots 42 are arranged in staggered positions so that the tangs 44 which extend from each end of each slot 42 are more dispersed throughout the area of the flat portion 38.

The flange-engaging bent portion 40 is entirely on the opposite side of the plane of the flat portion 38 from the side of the tangs 44, and includes a first outwardly extending portion 46 connected to the flat portion 38, extending outwardly and forwardly away from the flat portion 38, a second inwardly extending portion 48 connected to the first portion 46, extending inwardly and also forwardly away from the flat portion 38, and a third outwardly extending curved lip portion 50. The flange-contacting junction 52 between portion 48 and 50 is located a distance out of the plane of flat portion 38 less than the thickness of the double thickness flanges 20.

The clips 34 are each located with the clip lip portion 50 spaced about ¼ inch inward from the wallboard edge. The clips 34 are driven into the back of the wallboard using a hammer and a specially shaped tool to lie against the back of the clip, conforming to the shape of the clip with a permanently magnetized front face. The wallboard 32 is attached to the studs 16 by inserting a flange 20 in between a wallboard edge portion 36 and a clip bent portion 40. The four flanges 20 of each stud 16 will engage and hold respectively one of the edges of each of four separate wallboards 32.

If the wallboard is 36 inches wide or less there is no need for any more studs 16 than one at each wallboard joint 54. With 48 inch wide wallboard an additional stud (not shown) should be placed halfway between each set of wallboard joints 54, and a few dabs of adhesive should then be used to adhere spaced spots of wallboard to the intermediate studs. With a limited amount of adhesive, the wallboard is still demountable, and can be replaced using a few new dabs of adhesive at new spaced spots on the wallboard back face.

In erecting the partition 10, the first two wallboards 32 at one end of the partition 10 are placed against the floor track 12 and the ceiling track 14, with six clips 34 in place on the back of each wallboard 32. At the end of the partition a special C-shaped sheet metal stud (not shown) similar to stud 16, except with flanges extending in only one direction from the web, is inserted between the wallboard edge portions 36 and the clips 34. At the opposite vertical edge portions 36, flanges 20*a* and 20*c* of a stud 16 are inserted between the wallboard edge portions 36 and the clips 34 thereon. The bottom and top of these first two wallboards are screwed to the floor track and the ceiling track, respectively.

The next two wallboards 32, with six clips 34 in place on the back, are then placed against the floor track 12 and the ceiling track 14, and the wallboard edge portions 36 and the clips 34 thereon, on the edges adjacent the stud 16 are engaged with the flanges 20*b* and 20*d*. A second stud is then placed at the opposite side of these next two wallboards 32 and inserted between the wallboard edge portions 36 and the clips 34 thereon. The bottoms and tops of these next two wallboards 32 are screwed to the floor track 12 and the ceiling track 14. Additional wallboards 32 and studs 16 are progressively erected and interlocked similarly.

Having completed a detailed disclosure of the preferred embodiments of my invention so that those skilled in the art may practice the same, I contemplate that variations may be made without departing from the essence of the invention or the scope of the appended claims.

I claim:

1. A wallboard fastener clip comprising a single almost flat sheet metal body from which a plurality of short tangs are partially cut and bent perpendicularly therefrom, said almost flat body including a wallboard-engaging rearward flat portion and a flange-engaging forwardly extending, forward, almost flat portion disposed slightly out of the plane of said rearward flat portion and extending away from said rearward portion, said plurality of tangs being elongate, narrow strips of sheet metal cut from the sheet metal of said rearward flat portion and extending perpendicularly from said rearward flat portion in a direction opposite to the side of said flat portion on which said forwardly extending portion is disposed, said forwardly extending portion having a stud flange contacting portion which is disposed slightly outside of the plane of said rearward flat portion.

2. A wallboard fastener clip as defined in claim 1 wherein said tangs are about 0.1 inch wide and about 5/16 inch long.

3. A wallboard fastener clip as defined in claim 1 wherein said forwardly extending portion includes a first outwardly extending portion connected at one end to said rearward flat portion, a second inwardly extending portion connected to said first portion and a third outwardly extending lip portion connected to said second portion at said stud flange contacting portion.

4. A wallboard fastener clip as defined in claim 1 wherein the number of tangs extending perpendicularly from said rearward flat portion is about ten.

5. A wallboard fastener clip as defined in claim 4 wherein said tangs are formed of metal removed from said rearward flat portion, said removed metal forming laterally extending slots with two tangs being formed from the metal of each said slot, and said slots being in a staggered arrangement.

6. A progressive demountable partition comprising a plurality of vertical metal studs of an I-shaped cross section, said studs being mounted in vertical parallel spaced relation, with a plurality of wallboards mounted against the flanges of said I-shaped stud on both sides of said partition, each said wallboard having a plurality of wallboard fastener clips as defined in claim 1 affixed in spaced positions along each vertical edge, said clips having a plurality of short tangs driven into the back face of said wallboard and having said flange-engaging forwardly extending portion disposed on the inner surface of said stud flanges.

7. A progressive demountable partition as defined in claim 6 wherein said vertical studs are mounted at respective bottom and top ends in a floor track and a ceiling track, and said wallboards are gypsum wallboards.

8. A progressive demountable partition as defined in claim 7 wherein said wallboard is mechanically affixed at the bottom and top edges to respectively said floor track and said ceiling track.

9. A progressive demountable partition as defined in claim 6 wherein each said stud is formed of a single folded sheet of sheet metal and includes one flange on each side of said stud having a double thickness of sheet metal and a second flange on each side of said stud having a short double thick edge portion.

10. A progressive demountable partition as defined in claim 6 wherein said clips on each wallboard edge are disposed in about two-foot apart spaced positions.

* * * * *